US009391381B2

(12) United States Patent
Kato et al.

(10) Patent No.: US 9,391,381 B2
(45) Date of Patent: Jul. 12, 2016

(54) TERMINAL BLOCK AND ELECTRONICS DEVICE UNIT

(75) Inventors: Kengo Kato, Chiyoda-ku (JP); Kenichi Shimodaira, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 394 days.

(21) Appl. No.: 13/634,406

(22) PCT Filed: Nov. 25, 2011

(86) PCT No.: PCT/JP2011/077256
§ 371 (c)(1),
(2), (4) Date: Sep. 12, 2012

(87) PCT Pub. No.: WO2012/077515
PCT Pub. Date: Jun. 14, 2012

(65) Prior Publication Data

US 2013/0003340 A1 Jan. 3, 2013

(30) Foreign Application Priority Data

Dec. 8, 2010 (WO) ..... PCT/JP2010/072048

(51) Int. Cl.
*H01R 9/24* (2006.01)
*H01R 12/51* (2011.01)
*H01R 4/48* (2006.01)

(52) U.S. Cl.
CPC ..... *H01R 9/2475* (2013.01); *H01R 4/4836* (2013.01); *H01R 12/515* (2013.01)

(58) Field of Classification Search
CPC .. H01R 9/2475; H01R 4/4836; H01R 12/515; H01R 13/465; H01R 4/4845; H01R 9/2491; H01R 12/58; H01H 71/08
USPC ..... 361/822–824, 833, 835–837; 439/441; 206/459.1, 459.5
See application file for complete search history.

(56) References Cited

U.S. PATENT DOCUMENTS 3,989,338 A * 11/1976 Gosser ..... 439/43
4,820,193 A * 4/1989 Noorily ..... 439/488

(Continued)

FOREIGN PATENT DOCUMENTS

CN 86101089 A 9/1986
CN 2796161 Y 7/2006

(Continued)

OTHER PUBLICATIONS

Chinese Office Action, mailed Jun. 23, 2014; Application No. 201180017084.4.

(Continued)

*Primary Examiner* — Adrian S Wilson
*Assistant Examiner* — Abhishek Rathod
(74) *Attorney, Agent, or Firm* — Sughrue Mion, PLLC

(57) ABSTRACT

A terminal block includes a top surface formed to be flat, a concave portion formed on the top surface, and a plurality of wiring connecting holes arranged in the concave portion. Wiring display parts corresponding to the wiring connecting holes are arranged on the top surface. The concave portion is arranged in plural for each wiring group. A buttonhole is arranged adjacent to the wiring connecting hole and an opening/closing button for opening and closing a wiring connection fitting located on a bottom part of the wiring connecting hole is accommodated in the buttonhole. The concave portion is a belt-shaped groove.

14 Claims, 5 Drawing Sheets

(56) References Cited

U.S. PATENT DOCUMENTS

| | | | | |
|---|---|---|---|---|
| 5,341,269 | A * | 8/1994 | Hayward | H01H 85/547 361/111 |
| 5,483,229 | A * | 1/1996 | Tamura et al. | 340/691.7 |
| 5,669,788 | A * | 9/1997 | Brockman | H01R 9/2675 439/511 |
| 6,074,240 | A * | 6/2000 | Bradshaw et al. | 439/412 |
| 6,135,505 | A | 10/2000 | Fendt et al. | |
| 6,280,238 | B1 | 8/2001 | Baker et al. | |
| 6,324,057 | B1 * | 11/2001 | Baran et al. | 361/690 |
| 7,645,158 | B2 * | 1/2010 | Mulhouse et al. | 439/441 |
| 7,744,411 | B2 | 6/2010 | Casses et al. | |
| 7,786,831 | B2 * | 8/2010 | Oh | 335/202 |
| 8,262,405 | B1 * | 9/2012 | Bishop | 439/439 |
| 2002/0187670 | A1 * | 12/2002 | Cisey | 439/441 |
| 2006/0086530 | A1 * | 4/2006 | Knabel | 174/135 |
| 2007/0099479 | A1 * | 5/2007 | Holterhoff et al. | 439/441 |
| 2007/0207662 | A1 * | 9/2007 | Germani | H01R 4/4845 439/436 |
| 2008/0214038 | A1 * | 9/2008 | Poulin et al. | 439/345 |
| 2008/0280497 | A1 * | 11/2008 | Casses et al. | 439/660 |
| 2010/0081316 | A1 * | 4/2010 | Eppe et al. | 439/441 |
| 2010/0167573 | A1 * | 7/2010 | Dhandapani et al. | 439/345 |
| 2011/0048050 | A1 * | 3/2011 | Moteki et al. | 62/263 |
| 2011/0065330 | A1 * | 3/2011 | Miller et al. | 439/709 |

FOREIGN PATENT DOCUMENTS

| | | | |
|---|---|---|---|
| CN | 101459288 | A | 6/2009 |
| DE | 102008025432 | A1 | 9/2009 |
| DE | 202009002158 | U1 | 6/2010 |
| FR | 2844925 | A | 3/2004 |
| JP | 2-50974 | A | 4/1990 |
| JP | 2-170373 | A | 7/1990 |
| JP | 8-64270 | A | 3/1996 |
| JP | 8-180923 | A | 7/1996 |
| JP | 2007-522626 | A | 8/2007 |

OTHER PUBLICATIONS

European Office Action, mailed Jul. 22, 2014, Application No. 11846593.9.

Communication dated Jun. 10, 2015, issued by the European Patent Office in corresponding European Application No. 11 846 593.9.

Communication dated Dec. 16, 2015 from the European Patent Office issued in corresponding Application No. 11846593.9.

* cited by examiner

TERMINAL BLOCK AND ELECTRONICS DEVICE UNIT

CROSS REFERENCE TO RELATED APPLICATIONS

This application is a National Stage of International Application No. PCT/JP2011/077256 filed on Nov. 25, 2011, which claims priority from International Application No. PCT/JP2010/072048, filed on Dec. 8, 2010, the contents of all of which are incorporated herein by reference in their entirety.

FIELD

The present invention relates to a terminal block and to an electronic device unit including a terminal block, a wiring substrate having electronic components mounted thereon, and a case covering the electronic components and the wiring substrate.

BACKGROUND

Conventionally, there is disclosed an attachment configuration of a terminal name plate of an electronic device as follows. That is, a plurality of electronic devices having a top surface thereof exposed are stacked in a staged manner, each of the electronic devices includes a terminal part and a terminal name part placed on a tip end of a case, the terminal part and the terminal name part are shifted with one another so that the terminal parts and terminal name parts of respective electronic devices are not visually blocked by an electronic device immediately above them, a surface of the terminal name part is inclined, and a terminal name plate is attached on the inclined surface (see, for example, Patent Literature 1).

CITATION LIST

Patent Literature

Japanese Utility Model Laid-open Publication No. H02-050974

SUMMARY

Technical Problem

However, in the conventional technique described above, a surface of the terminal name part is inclined and a terminal name plate is attached on the inclined surface. In addition, terminal parts and a partition plate partitioning these terminal parts project vertically with respect to the surface of the terminal name part. Therefore, because the projecting terminal parts and partitioning plate become hindrance, it is not possible to print (serigraph) a terminal name on the terminal name part, and thus a terminal name plate has to be attached on the terminal name part. Consequently, there has been a problem that the manufacturing cost of the terminal name plate and the attachment work of the plate cause a cost increase.

The present invention has been made in view of the above problem, and an object of the present invention is to provide a terminal block and an electronic device unit having a wiring display part (terminal name part) on which a wiring name can be printed.

Solution to Problem

To solve the above described problem and to achieve the object, a terminal block according to the present invention includes: a top surface formed to be flat; a concave portion formed on the top surface; and a plurality of wiring connecting holes provided in the concave portion.

Advantageous Effects of Invention

The terminal block according to the present invention has a flat top surface on which respective wiring display parts, corresponding to respective wiring connecting holes, can be printed and thus cost reduction can be achieved.

DESCRIPTION OF EMBODIMENTS

Exemplary embodiments of a terminal block and an electronic device unit according to the present invention will be explained below in detail with reference to the accompanying drawings. The present invention is not limited to the embodiments.

First Embodiment

Figure 1:
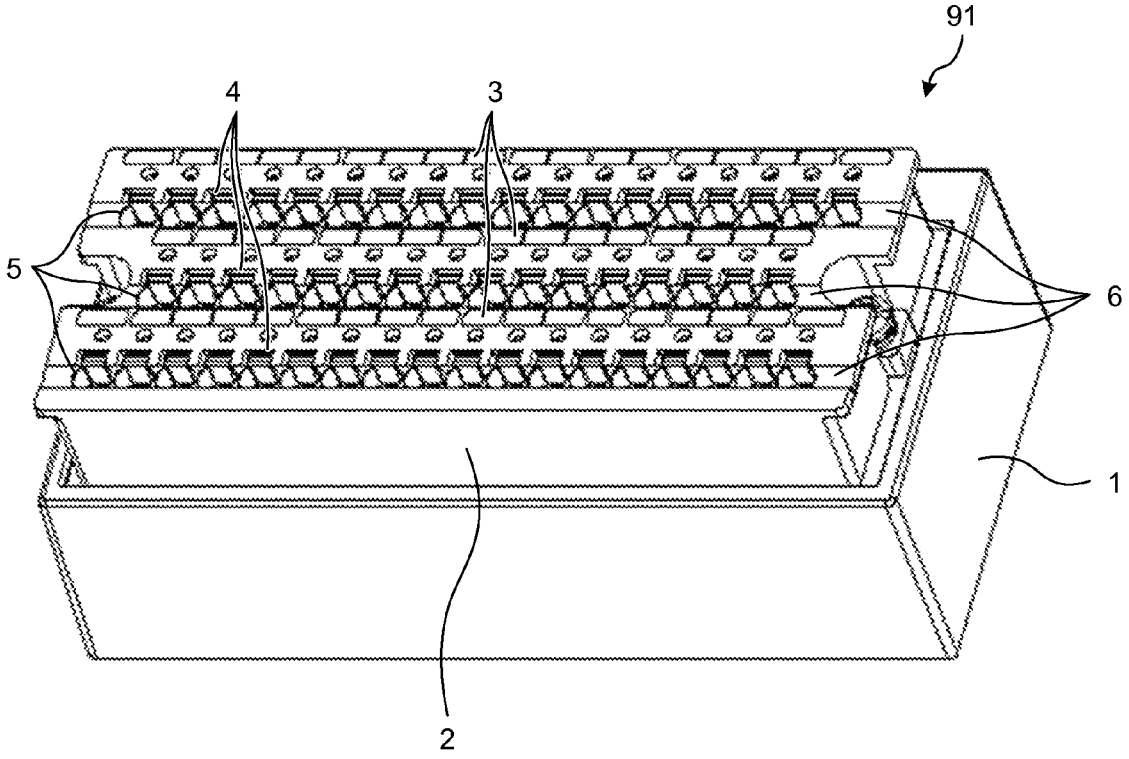
FIG. 1 is a perspective view of an electronic device unit according to a first embodiment of the present invention.
Figure 2:
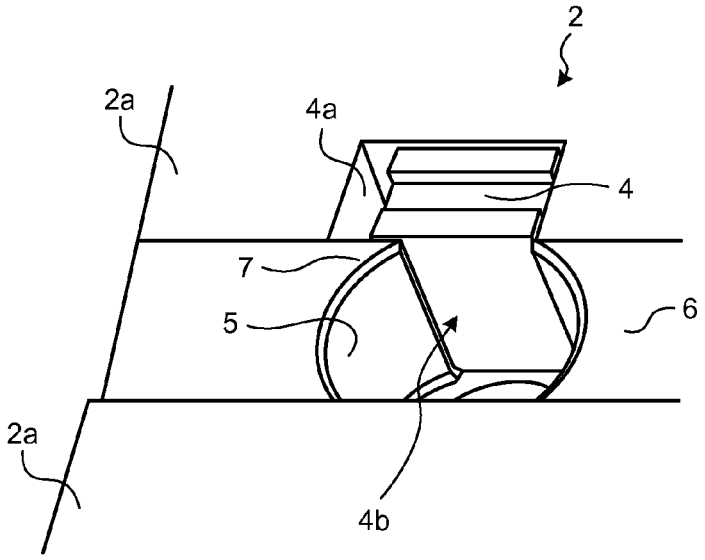
FIG. 2 is a perspective view of a top surface of a terminal block of the electronic device unit according to the first embodiment.
Figure 3:
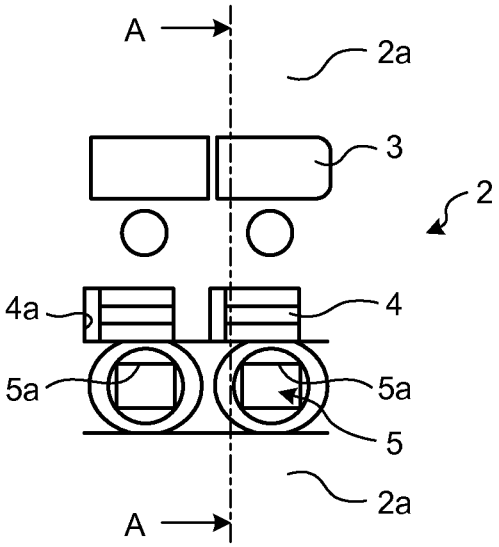
FIG. 3 is a top view of the top surface of the terminal block of the electronic device unit according to the first embodiment.
Figure 4:
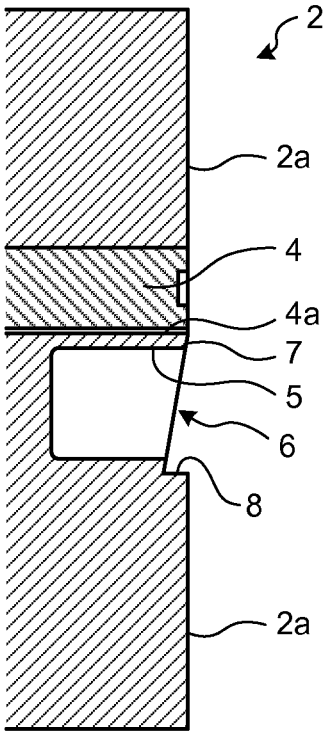
FIG. 4 is a cross-sectional view along a line A-A in FIG. 3.

FIG. 1 is a perspective view of an electronic device unit according to a first embodiment of the present invention, FIG. 2 is a perspective view of a top surface of a terminal block of the electronic device unit according to the first embodiment, FIG. 3 is a top view of the top surface of the terminal block of the electronic device unit according to the first embodiment, and FIG. 4 is a cross-sectional view along a line A-A in FIG. 3.

An electronic device unit 91 according to the first embodiment includes a wiring substrate (not illustrated) having electronic components (not illustrated) and a terminal block 2 in a rectangular board shape mounted thereon, and a case 1 in a rectangular parallelepiped box shape covering the electronic components and the wiring substrate.

A top surface 2*a* of the terminal block 2 has no projections or the like and is formed to be flat. On the top surface 2*a* of the terminal block 2, belt-shaped grooves 6 as concave portions are formed for each wiring group that is connected to the terminal block 2. Three grooves 6 as concave portions are formed for three wiring groups.

In each of the grooves 6, a plurality of wiring connecting holes 5 having a wiring connection fitting 5*a* located on a bottom part thereof are provided. The wiring connection fitting 5*a* clamps a conductor of a wire from which insulating coating is peeled off, and electrically connects the wire and the electronic device unit 91. Wires in the same group are connected to the wiring connecting holes 5 provided in one of the grooves 6. Because the wires in the same group are connected to the wiring connecting holes 5 provided in one of the grooves 6, erroneous wiring can be prevented.

A rectangular buttonhole 4*a* is provided adjacent to each of the wiring connecting holes 5. An opening/closing button 4 for releasing a wire by opening the wiring connection fitting 5*a* with a pressing operation is accommodated in the buttonhole 4*a*.

The wiring connecting hole 5 and the buttonhole 4*a* are formed to be partially overlapped, and the overlapped part serves as a rectangular communication opening 4*b*. An edge part 7 provided between the wiring connecting hole 5 and the buttonhole 4*a* supports the opening/closing button 4 such that the opening/closing button 4 does not fall into the wiring connecting hole 5. Arrays of respective wiring display parts 3 corresponding to respective wiring connecting holes 5 are provided in parallel to the belt-shaped grooves 6 in the vicinity of each of the buttonholes 4*a* of the flat top surface 2*a* of the terminal block 2.

A bottom surface of the belt-shaped grooves 6 is formed to be an inclined surface, which has a downward inclination toward the width direction with respect to a direction to be away from the buttonhole 4*a*. An edge part of the groove 6 further from the buttonhole 4*a* is formed to be a stepped part 8. An edge part of the groove 6 closer to the buttonhole 4*a* is continuous to the top surface 2*a* of the terminal block 2. By arranging the inclined surface and the stepped part 8 in the groove 6, it is possible to make the groove 6 to be conspicuous and this is useful for preventing erroneous wiring.

Because the wiring connecting holes 5 are provided in the belt-shaped grooves 6 and the opening/closing button 4 is accommodated in the buttonhole 4*a*, there is no projection from the top surface 2*a* of the terminal block 2. Therefore, terminal names can be printed on all of the wiring display parts 3 arranged on the flat top surface 2*a* of the terminal block 2 by one printing process (serigraph).

Second Embodiment

Figure 5:
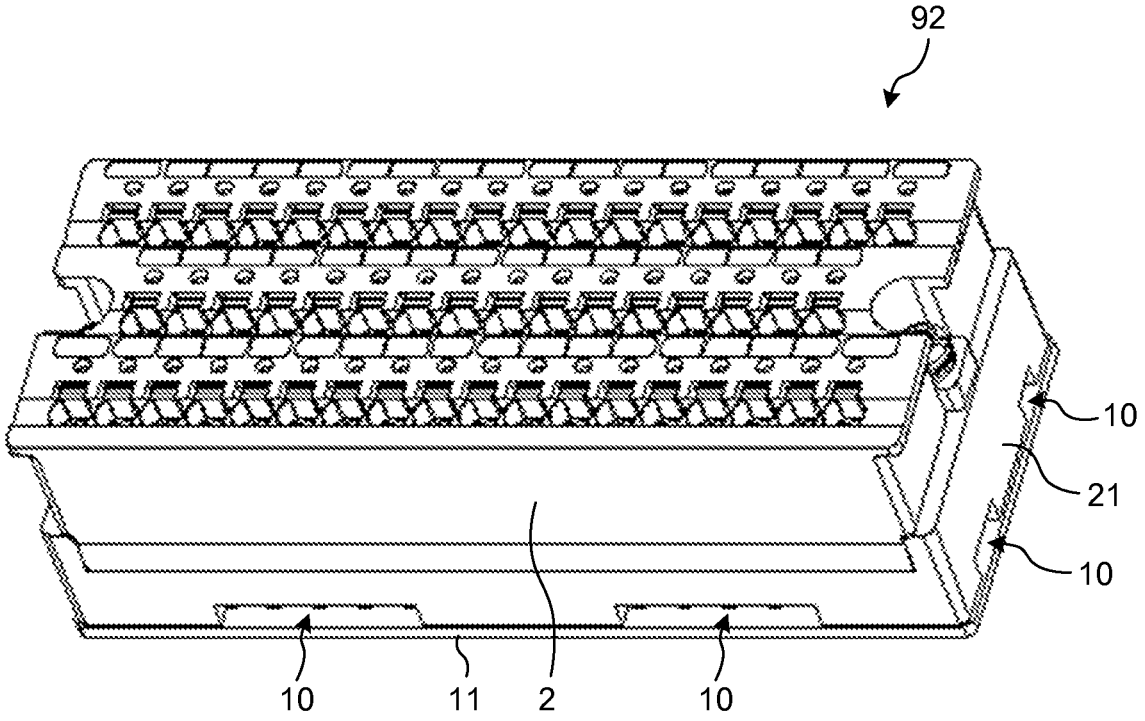
FIG. 5 is a perspective view of an electronic device unit according to a second embodiment of the present invention.

FIG. 5 is a perspective view of an electronic device unit according to a second embodiment of the present invention. An electronic device unit 92 according to the second embodiment includes a terminal block 2 that is equivalent to the terminal block 2 of the electronic device unit 91 according to the first embodiment. In the electronic device unit 92 according to the second embodiment, electronic components (not illustrated) that cannot be mounted on a wiring substrate 11 due to overflow are mounted on a bottom surface of the terminal block 2, and a plurality of ventilation holes 10 are provided in a case 21.

In the electronic device unit 92 according to the second embodiment, it is possible to mount a larger number of electronic components caused by diversified functions of the electronic device unit 92 without increasing the number of the wiring substrates 11 or without increasing the size of the electronic device unit 92. In addition, because the ventilation holes 10 are provided in the case 21, an excellent heat releasing characteristic can be realized.

Third Embodiment

Figure 6:
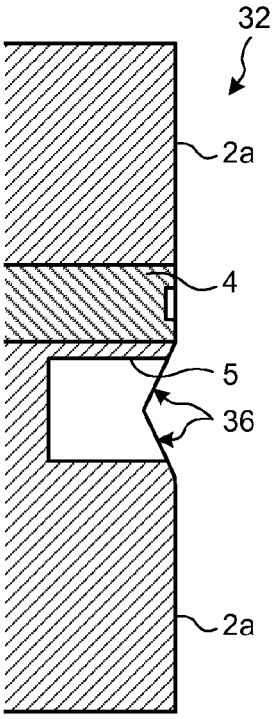
FIG. 6 is a cross-sectional view of a terminal block of an electronic device unit according to a third embodiment of the present invention.

FIG. 6 is a cross-sectional view of a terminal block of an electronic device unit according to a third embodiment of the present invention. As illustrated in FIG. 6, the top surface 2*a* of a terminal block 32 according to the third embodiment has no projections or the like and is formed to be flat. On the top surface 2*a* of the terminal block 32, a belt-shaped groove (a concave portion) 36 is formed for each wiring group that is connected to the terminal block 32. The belt-shaped groove 36 is a V-shaped groove having a downward inclination toward the center in the width direction.

Except for the shape of the groove (the concave portion) 36, features of the terminal block 32 according to the third embodiment are identical to those of the terminal block 2 according to the first embodiment. By forming the groove 36 to be a V-shaped groove, the groove 36 becomes conspicuous and erroneous wiring can be prevented. Furthermore, when a conductor of a wire is inserted into the wiring connecting hole 5, the tip end of the conductor is guided by the V-shaped inclined surface to reach the wiring connecting hole 5, and thus the workability of connecting the wire can be improved.

Fourth Embodiment

Figure 7:
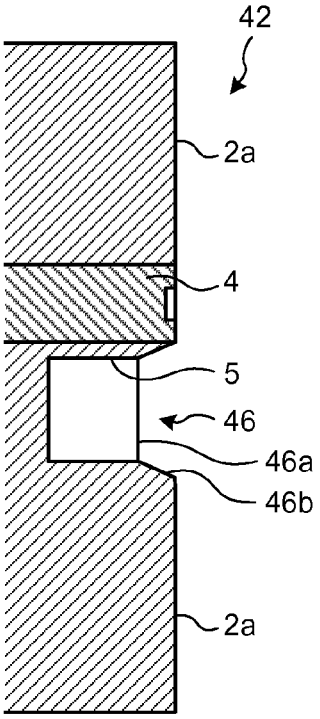
FIG. 7 is a cross-sectional view of a terminal block of an electronic device unit according to a fourth embodiment of the present invention.

FIG. 7 is a cross-sectional view of a terminal block of an electronic device unit according to a fourth embodiment of the present invention. As illustrated in FIG. 7, the top surface 2*a* of a terminal block 42 according to the fourth embodiment has no projections or the like and is formed to be flat. On the top surface 2*a* of the terminal block 42, a belt-shaped groove (a concave portion) 46 is formed for each wiring group that is connected to the terminal block 42. The belt-shaped groove 46 is trapezoidal in cross section, and has a bottom surface 46*a* arranged in the wiring connecting hole 5 and an inclined surface 46*b* on both sides of the bottom surface 46*a*.

Except for the shape of the groove (the concave portion) 46, features of the terminal block 42 according to the fourth embodiment are identical to those of the terminal block 2 according to the first embodiment. Because the inclined surface 46*b* is arranged in the groove 46, the groove 46 becomes conspicuous and erroneous wiring can be prevented. Furthermore, when a conductor of a wire is inserted into the wiring connecting hole 5, the tip end of the conductor is guided by the inclined surface 46*b* to reach the wiring connecting hole 5, and thus the workability of connecting the wire can be improved.

Fifth Embodiment

Figure 8:
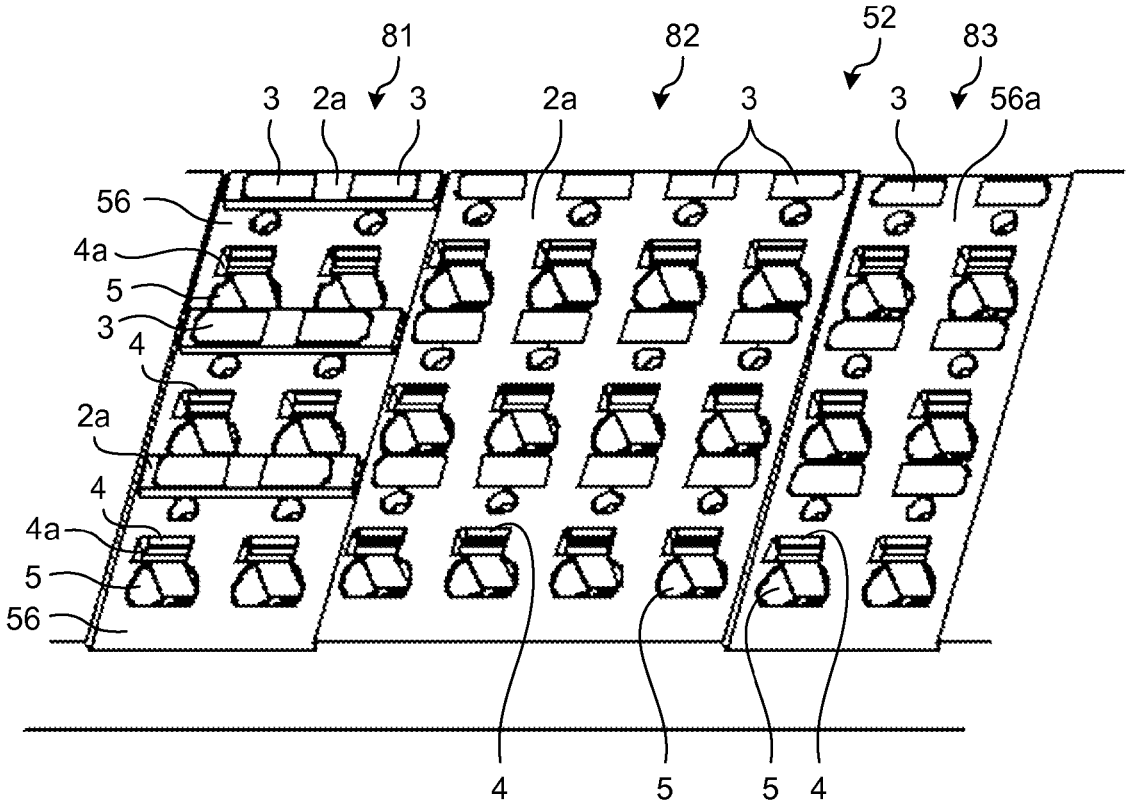
FIG. 8 is a perspective view of a terminal block of an electronic device unit according to a fifth embodiment of the present invention.

FIG. 8 is a perspective view of a terminal block of an electronic device unit according to a fifth embodiment of the present invention. As illustrated in FIG. 8, a terminal block 52 according to the fifth embodiment includes a first, second, and third regions 81, 82, and 83 for three wiring groups.

In the first and second regions 81 and 82, the top surface 2*a* of the terminal block 52 has no projections or the like and is formed to be flat. In the first region 81, grooves 56 as belt-shaped concave portions for a first wiring group are formed. A bottom surface of the grooves 56 is parallel to the top surface 2*a*.

A plurality of the wiring connecting holes 5 having the wiring connection fitting 5*a* (see FIG. 3) located on a bottom part thereof are arranged on the bottom surface of the grooves 56. Wires in the first wiring group are connected to the wiring connecting holes 5 arranged in the grooves 56. Because the wires in the first wiring group are connected to the wiring connecting holes 5 arranged in one of the grooves 56, erroneous wiring can be prevented.

The rectangular buttonhole 4*a* is arranged adjacent to each of the wiring connecting holes 5. The opening/closing button 4 for releasing a wire by opening the wiring connection fitting 5*a* with a pressing operation is accommodated in the buttonhole 4*a*. Respective wiring display parts 3 corresponding to respective wiring connecting holes 5 are arranged on the top surface 2*a* near each of the buttonholes 4*a* in the first region 81.

In the first region 81, because the wiring connecting holes 5 are arranged in the grooves 56 and the opening/closing button 4 is accommodated in the buttonhole 4*a*, there is no projection from the top surface 2*a*. Therefore, terminal names of all of the wiring display parts 3 arranged on the top surface 2*a* in the first region 81 can be printed by one printing process (serigraph).

In the second region 82, the top surface 2*a* of the terminal block 52 has no projections or the like and is formed to be flat. In the second region 82, no concave portion (groove) for a second wiring group is provided.

A plurality of the wiring connecting holes 5 having the wiring connection fitting 5*a* (see FIG. 3) located on a bottom part thereof are arranged on the top surface 2*a* in the second region 82. Wires in the second wiring group are connected to the wiring connecting holes 5 arranged in the second region 82.

In the second region 82, while the wiring connecting holes 5 and the buttonholes 4*a* are arranged on the top surface 2*a*, there is no projection from the top surface 2*a*, and thus terminal names of all of the wiring display parts 3 arranged on the flat top surface 2*a* in the second region 82 can be printed by one printing process (serigraph).

The third region 83 has no top surface 2*a*, which is arranged in the first and second regions 81 and 82. In the third region 83, grooves 56*a* as belt-shaped concave portions for a third wiring group are formed. A bottom surface of the grooves 56*a* is parallel to the top surface 2*a* of the first and second regions 81 and 82.

A plurality of the wiring connecting holes 5 having the wiring connection fitting 5*a* (see FIG. 3) arranged on a bottom part thereof, the buttonholes 4*a*, and the wiring display parts 3 are provided on the bottom surface of the grooves 56*a*. Wires in the third wiring group are connected to the wiring connecting holes 5 arranged in the grooves 56*a*. Because the wires in the third wiring group are connected to the wiring connecting holes 5 arranged in one of the grooves 56*a*, erroneous wiring can be prevented.

Furthermore, because the second region 82 is sandwiched by the groove 56 of the first region 81 and the groove 56*a* of the third region 83, the second region 82 can be distinguished from the first and third regions 81 and 83, and erroneous wiring of the second wiring group can be prevented.

In the third region 83, the wiring display parts 3 are arranged on the bottom surface of the grooves 56*a*, and thus printing of terminal names of the wiring display parts 3 cannot be performed simultaneously with printing of terminal names of the wiring display parts 3 in the first and second regions 81 and 82. Therefore, the printing of terminal names in the third region 83 has to be performed separately from that in the first and second regions 81 and 82.

Sixth Embodiment

Figure 9:
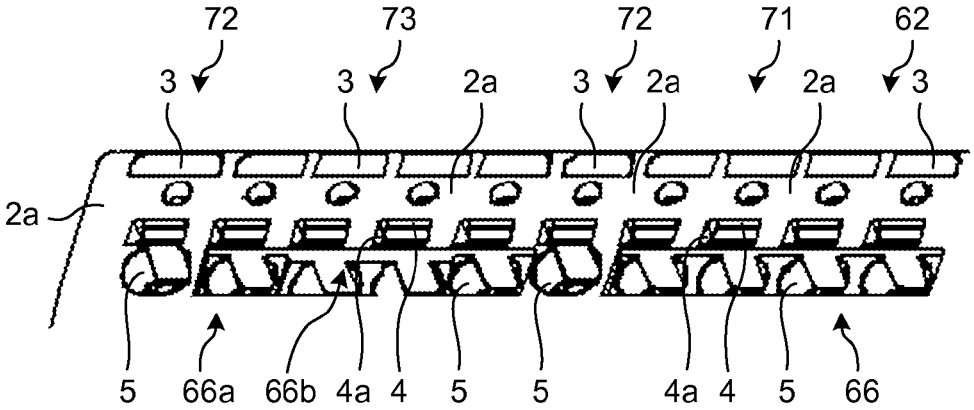
FIG. 9 is a perspective view of a terminal block of an electronic device unit according to a sixth embodiment of the present invention.

FIG. 9 is a perspective view of a terminal block of an electronic device unit according to a sixth embodiment of the present invention. As illustrated in FIG. 9, a terminal block 62 according to the sixth embodiment includes a first, second, and third regions 71, 72, and 73 for three wiring groups.

In the first, second, and third regions 71, 72, and 73, the top surface 2*a* of the terminal block 62 has no projections or the like and is formed to be flat. In the first region 71, grooves 66 as belt-shaped concave portions for a first wiring group are formed. A bottom surface of the grooves 66 is parallel to the top surface 2*a*.

A plurality of the wiring connecting holes 5 having the wiring connection fitting 5*a* (see FIG. 3) arranged on a bottom part thereof are provided on the bottom surface of the grooves 66. Wires in the first wiring group are connected to a plurality (four) of the wiring connecting holes 5 provided in the grooves 66. Because the wires in the first wiring group are connected to the wiring connecting holes 5 arranged in one of the grooves 66, erroneous wiring can be prevented.

The rectangular buttonhole 4*a* is arranged adjacent to each of the wiring connecting holes 5. The opening/closing button 4 for releasing a wire by opening the wiring connection fitting 5*a* with a pressing operation is accommodated in the buttonhole 4*a*. Respective wiring display parts 3 corresponding to respective wiring connecting holes 5 are arranged in the vicinity of each of the buttonholes 4*a* of the flat top surface 2*a* in the first region 71.

The second region 72 is separated into two parts while sandwiching the third region 73. In the second region 72, no concave portion (groove) for a second wiring group is provided. A plurality (two) of the wiring connecting holes 5 having the wiring connection fitting 5*a* (see FIG. 3) arranged on a bottom part thereof are provided on the top surface 2*a* of the second region 72. Wires in the second wiring group are connected to a plurality of the wiring connecting holes 5 in the second region 72.

In the third region 73, grooves 66*a* as belt-shaped concave portions for a third wiring group are formed. A bottom surface of the grooves 66*a* is parallel to the top surface 2*a*. In a central part in the grooves 66*a*, deep grooves 66*b* that are lower, by a certain degree, than grooves 66*a* are formed.

Two wiring connecting holes 5 having the wiring connection fitting 5*a* (see FIG. 3) located on a bottom part thereof are respectively arranged on a bottom surface of the grooves 66*a* and of the deep grooves 66*b*. Wires in the third wiring group are connected to the two wiring connecting holes 5 provided in the grooves 66*a*, and wires of a sub-group in the third wiring group are connected to the two wiring connecting holes 5 provided in the deep grooves 66*b*. Because the wires in the third wiring group and those in the sub-group are respectively connected to the wiring connecting holes 5 provided in the grooves 66*a* and the deep grooves 66*b*, erroneous wiring can be prevented.

The rectangular buttonhole 4*a* is arranged adjacent to each of the wiring connecting holes 5 in the third region 73. The opening/closing button 4 for releasing a wire by opening the wiring connection fitting 5*a* with a pressing operation is accommodated in the buttonhole 4*a*. Respective wiring display parts 3 corresponding to respective wiring connecting holes 5 are provided in the vicinity of each of the buttonholes 4*a* of the flat top surface 2*a* in the third region 73.

In the second region 72, no concave portion (groove) is provided. Therefore, the second region 72 can be distinguished from the first and third regions 71 and 73, and erroneous wiring of the second wiring group can be prevented. In addition, because the first, second, and third regions 71, 72, and 73 share one flat top surface 2*a* and there is no projection, terminal names of the wiring display parts 3 can be printed by one printing process (serigraph).

INDUSTRIAL APPLICABILITY

As described above, the terminal block and the electronic device unit according to the present invention are suitable for a terminal block and an electronic device unit in which a large number of wires are connected.

REFERENCE SIGNS LIST

1, 21 CASE
2, 32, 42, 52, 62 TERMINAL BLOCK
2*a* TOP SURFACE
3 WIRING DISPLAY PART
4 OPENING/CLOSING BUTTON
4*a* BUTTONHOLE
4*b* COMMUNICATION OPENING
5 WIRING CONNECTING HOLE
5*a* WIRING CONNECTION FITTING
6, 36, 46, 56, 56*a*, 66, 66*a* GROOVE (CONCAVE PORTION)
66*b* DEEP GROOVE
7 EDGE PART
8 STEPPED PART
10 VENTILATION HOLE
11 WIRING SUBSTRATE
71, 81 FIRST REGION
72, 82 SECOND REGION
73, 83 THIRD REGION
91, 92 ELECTRONIC DEVICE UNIT

The invention claimed is:

1. A terminal block, mounted on a wiring substrate covered by a case, comprising:
- a top surface including at least one flat portion and at least one concave portion;
- a plurality of wiring connecting holes provided in the at least one concave portion; and
- a plurality of wiring display parts on which terminal names are printed by one printing process, wherein
- the plurality of wiring display parts are provided so as correspond to the wiring connecting holes, wherein
- the at least one flat portion is the most elevated surface within the terminal block and the plurality of wiring display parts are provided on the most elevated surface within the terminal block, wherein
- the at least one flat portion and the at least one concave portion are provided in parallel along a longitudinal direction of the terminal block, wherein
- a length of the at least one flat portion and a length of the at least one concave portion are the same as a length of the terminal block in a longitudinal direction, wherein
- the at least one concave portion includes a plurality of concave portions respectively corresponding to each wiring group, and wherein
- adjacent concave portions of the plurality of concave portions are separated from each other by a flat portion of the at least one flat portion.

2. The terminal block according to claim 1, wherein a buttonhole is arranged adjacent to each of the plurality of wiring connecting holes and an opening/closing button configured to open and close a wiring connection fitting located on a bottom part of each of the plurality of wiring connecting holes is accommodated in the buttonhole.

3. The terminal block according to claim 1, wherein each of the plurality of concave portions is a belt-shaped groove.

4. The terminal block according to claim 3, wherein a bottom surface of the belt-shaped groove is inclined towards a width direction of the groove and an edge part of the belt-shaped groove further from a buttonhole is formed to be a stepped part.

5. The terminal block according to claim 4, wherein the belt-shaped groove has a V-shaped cross section.

6. The terminal block according to claim 3, wherein the belt-shaped groove has a trapezoidal cross section.

7. The terminal block according to claim 1, wherein the plurality of wiring connecting holes are provided only in the plurality of concave portions.

8. The terminal block according to claim 1, wherein the one printing process is serigraph printing.

9. The terminal block according to claim 1, wherein
- each concave portion of the plurality of concave portions is disposed between flat portions of the at least one flat portion, wherein
- the at least one flat portion includes a plurality of flat portions, and wherein
- the plurality of concave portions and the plurality of flat portions are alternately disposed with respect to a lateral axis direction of the terminal block.

10. An electronic device unit comprising:
- a terminal block mounted on a wiring substrate, wherein the terminal block includes:
  - a top surface including at least one flat portion and at least one concave portion;
  - a plurality of wiring connecting holes provided in the at least one concave portion; and
  - a plurality of wiring display parts on which terminal names are printed by one printing process, wherein
  - the plurality of wiring display parts are provided so as correspond to the plurality of wiring connecting holes; and
  - electronic components mounted on the wiring substrate; and
- a case covering the wiring substrate, wherein
- at least one flat portion of the top surface is the most elevated surface within the electronic device unit and the plurality of wiring display parts are provided on the most elevated surface within the electronic device unit, wherein
- the at least one flat portion and the at least one concave portion are provided in parallel along a longitudinal direction of the terminal block, wherein
- a length of the at least one flat portion and a length of the at least one concave portion are the same as a length of the terminal block in a longitudinal direction, wherein
- the at least one concave portion includes a plurality of concave portions respectively corresponding to each wiring group, and wherein
- adjacent concave portions of the plurality of concave portions are separated from each other by a flat portion of the at least one flat portion.

11. The electronic device unit according to claim 10, wherein electronic components that cannot be mounted on the wiring substrate due to overflow are mounted on a bottom surface of the terminal block.

12. The electronic device unit according to claim 10, wherein a ventilation hole is provided in the case.

13. The electronic device unit according to claim 10, wherein the one printing process is serigraph printing.

14. The terminal block according to claim 10, wherein
- each concave portion of the of the plurality of concave portions is disposed between flat portions of the at least one flat portion, wherein
- the at least one flat portion includes a plurality of flat portions, and wherein
- the plurality of concave portions and the plurality of flat portions are alternately disposed with respect to a lateral axis direction of the terminal block.

* * * * *